United States Patent [19]

Ward

[11] 3,999,701

[45] Dec. 28, 1976

[54] CURRENCY HOLDING FOLDER

[75] Inventor: James O. Ward, Portland, Oreg.

[73] Assignee: MAIL-WELL Envelope Company, Portland, Oreg.

[22] Filed: Sept. 8, 1975

[21] Appl. No.: 611,313

Related U.S. Application Data

[63] Continuation of Ser. No. 472,621, May 23, 1974, abandoned, which is a continuation of Ser. No. 331,981, Feb. 12, 1973, abandoned, which is a continuation of Ser. No. 127,728, March 24, 1971, abandoned.

[52] U.S. Cl. ..... 229/87 R; 40/359; 150/38; 206/491

[51] Int. Cl.[2] ..... B65D 65/12; B65D 75/04

[58] Field of Search ..... 206/491, 492, 525; 40/359; 282/12 R; 229/1.5 R, 68 R, 87 R, 87 S, 56; 150/38

[56] References Cited

UNITED STATES PATENTS

| | | | |
|---|---|---|---|
| 1,009,447 | 11/1911 | Shepherd | 40/359 |
| 1,461,399 | 7/1923 | Newsham | 282/12 R |
| 1,683,584 | 9/1928 | Hogan | 229/56 |

FOREIGN PATENTS OR APPLICATIONS

| | | | |
|---|---|---|---|
| 453,248 | 11/1949 | Italy | 150/38 |
| 578,346 | 9/1924 | France | 229/87 R |

*Primary Examiner*—Stephen P. Garbe
*Attorney, Agent, or Firm*—Klarquist, Sparkman, Campbell, Leigh, Hall & Whinston

[57] ABSTRACT

A currency holding folder having a bottom panel, a cover and a top flap holds bills of currency to form a packet of a predetermined thickness which can be checked by feelers to determine full loading. The top flap has an end cutout to provide clearance for a gripper of an inserting machine, and the top flap is narrower than the bottom panel so that the top flap does not go under a hold-down guide. The top flap is shorter than the bottom panel which has a corner cutout to expose the corners of currency bills in the folder. The cover is of substantially the same width as the bottom panel so that the front edge of the cover is at the edge of the folder.

9 Claims, 9 Drawing Figures

JAMES O. WARD
INVENTOR

BY
BUCKHORN, BLORE, KLARQUIST & SPARKMAN
ATTORNEYS

JAMES O. WARD
INVENTOR

BY

BUCKHORN, BLORE, KLARQUIST & SPARKMAN
ATTORNEYS

CURRENCY HOLDING FOLDER

CROSS REFERENCE TO RELATED APPLICATIONS

This application is a continuation of Ser. No. 472,621, filed May 23, 1974, now abandoned, which, in turn, is a continuation of Ser. No. 331,981, filed Feb. 12, 1973 (abandoned), which, in turn, is a continuation of Ser. No. 127,728, filed Mar. 24, 1971 (abandoned).

DESCRIPTION

This invention relates to a new and improved currency holding folder, and more particularly to a currency holding folder which can be handled by a currency dispensing machine.

An object of the invention is to provide a new and improved currency holding folder.

Another object of the invention is to provide a currency holding folder which can be handled by a currency dispensing machine.

A further object of the invention is to provide a currency holding folder of uniform thickness from one edge thereof across the major portion of the width of the folder and along substantially the entire length of the folder.

Another object of the invention is to provide a currency holding folder having a top flap which can be swung away from a cover flap to permit inserting currency bills into the folder.

Another object of the invention is to provide a currency holding folder having a corner cutout to expose corners of currency bills to check presence and denomination of the bills.

Another object of the invention is to provide a currency holding folder having a top flap which covers only a portion of the width of the folder to provide clearance of a hold-down bar of an inserting machine.

Another object of the invention is to provide a currency holding folder having a top flap having a cutout end portion to provide clearance for a gripper of an inserting machine.

Figure 8:
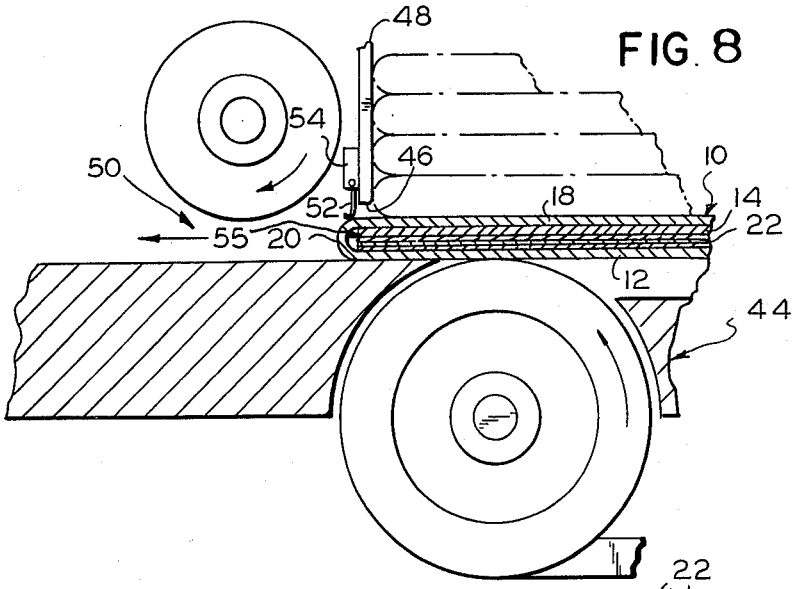
FIG. 8 is an enlarged fragmentary elevational view showing the outfeed station of a dispensing machine.

Referring now in detail to the drawings, there is shown therein a currency holding folder 10 forming one embodiment of the invention and adpated to hold currency and be fed through a currency dispensing machine without jamming. The folder also may be easily loaded with currency by envelope stuffing machines. The folder includes a bottom panel 12, a cover or tucked flap 14 connected to the rear edge of the bottom panel by a fold 16 and a top flap 18 connected to a front edge of the bottom panel by a fold 20. The folder securely carries a predetermined number of bills 22 (FIG. 8) of currency, three in the specific embodiment disclosed, in shallow pocket 24 formed between cover flap 14 and bottom panel 12. After the bills 23 are positioned in the pocket 24 the flap 18 is folded over the top of flap 14 enclosing the bills.

Figure 6:
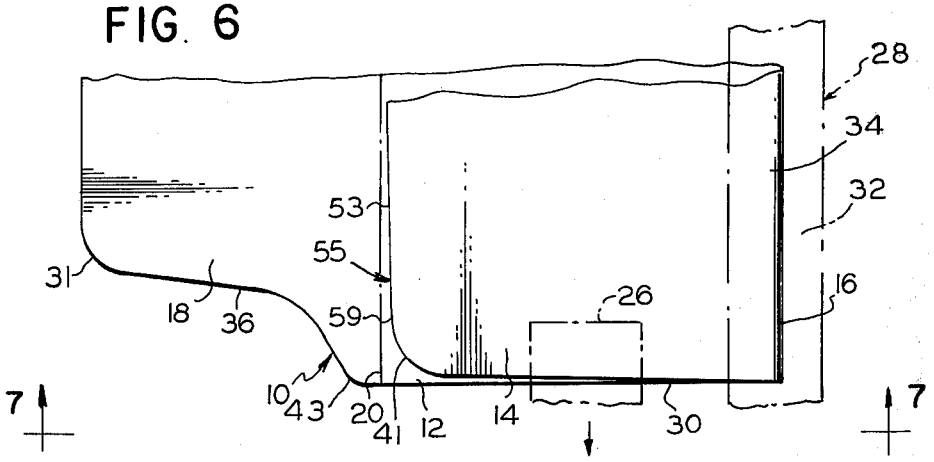
FIG. 6 is a full scale, fragmentary plan view of the folder of FIG. 1 ready to receive currency.
Figure 7:
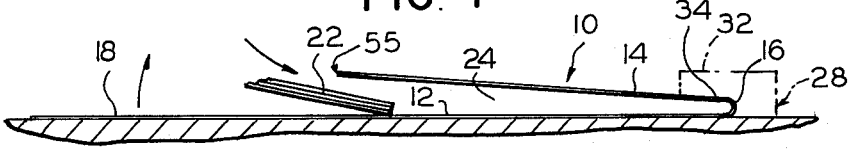
FIG. 7 is an edge view taken along line 7—7 of FIG. 6.

A gripper 26 (FIG. 6) forming part of an inserting machine 28 pulls the leading edge 30 of the folder into position to receive the bills of currency 22. The inserting machine is provided with a bar 32 to guide folded edge portion 34 while holding it down. The leading edge of the top flap 18 has a front end cutout 36 to provide clearance for the gripper 26. This cutout also provides a convenient area to be gripped by the user's thumb, for hand inserting.

Figure 1:
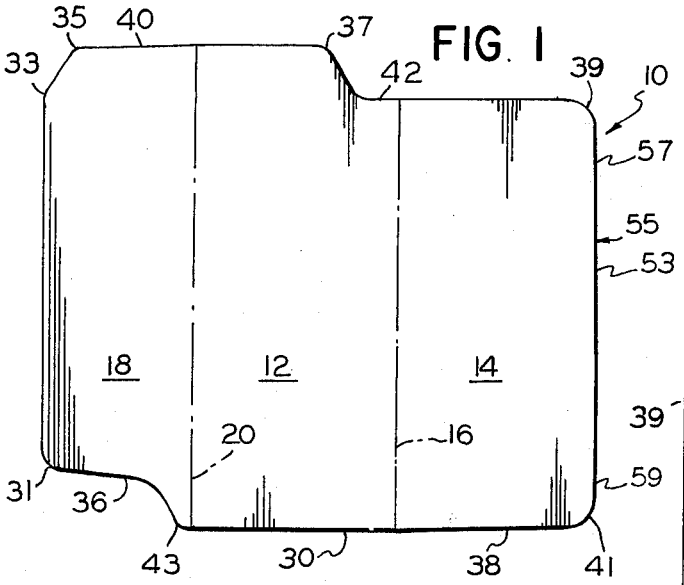
FIG. 1 is a reduced plan view of a new and improved currency holding folder forming one embodiment of the invention.

Front edge 38 of the cover flap 14 and rear edge 40 of the top flap 18 have each been cut at a slight angle to provide clearance to eliminate the possibility of jamming due to overhang. A second, corner cutout section 42 located at the trailing edge of the folder 10 gives a means of checking orientation of the folders when loading the machine. The cutout section 42 also permits viewing of the currency 22 assuring the amount and the fact that the particular holder has currency in it. Corners 31, 33, 35, 37, 39, 41 and 43 (FIG. 1) of the folder 10 are rounded to facilitate smooth handling of the flaps 14 and 18.

Figure 5:
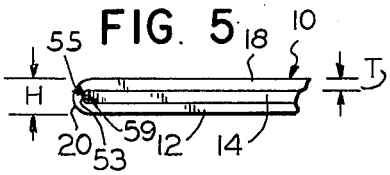
FIG. 5 is an enlarged, fragmentary, edge view of the folder of FIG. 1 showing the uniform height at the very edge.

All dimensions are closely controlled to eliminate any jamming during operation. The thickness "T" of the material used is maintained at from 0.0045 inches to 0.0052 inches to have an exact folder thickness "H" as shown in FIG. 5. The need for the exact thickness "H" can be seen in FIG. 8. Through a control means (not shown) a currency dispensing machine 44 dispenses the folders 10 with the currency 22 inside through an opening 46 in a face plate 48 of the machine 44. The opening 46 is large enough for only one folder 10 to pass through at a time and a conveyor feed system 50 passes the folder through the opening 46. A feeler 52 of a sensing device 54 checks to see that only the folder 10 is loaded with currency as the folder comes through the opening 46. Wider, central portion 53 of edge 55 of the cover flap 14 is closely adjacent the fold 20 so that the feeler 52 immediately engages the full thickness of the folder with its currency before the folder goes into the bite of the rolls. As viewed in FIGS. 1 and 3, the edge 55 tapers from the central portion, with a very flat curve, inwardly slightly to form narrower end portions 57 and 59. This insures that the wider central portion is in engagement with the fold 20. The taper to the portion 57 preferably is about one-eighth of an inch, about twice the taper to the portion 59, which is about one-sixteenth of an inch. The feeler 52 engages only the portion of the flap 18 over the central portion of the flap adjacent the central portion 53 of the edge 55.

Figure 3:
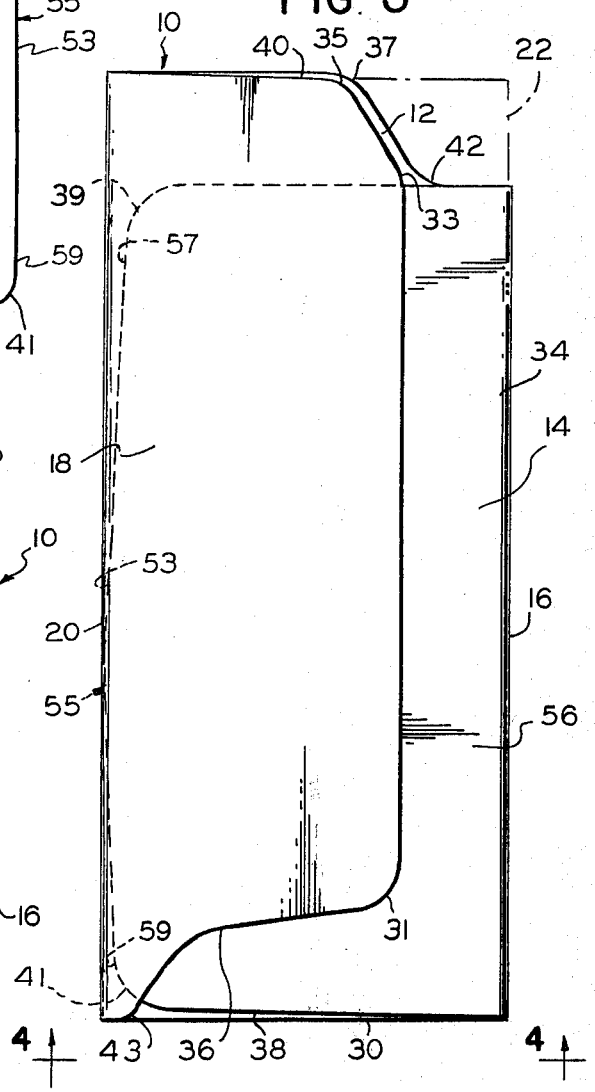
FIG. 3 is a full scale view of the folder of FIG. 1 with currency shown in phantom.
Figure 2:
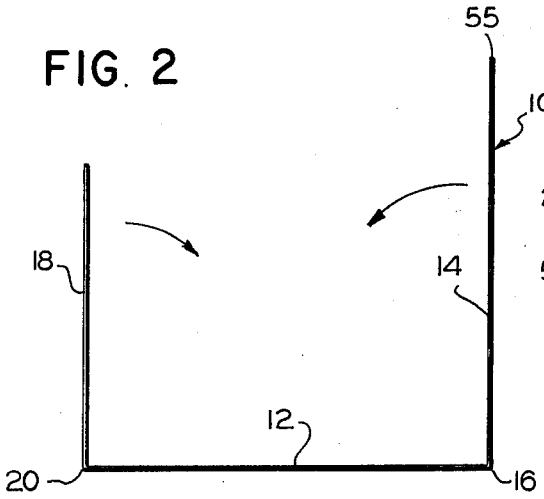
FIG. 2 is a full scale view of the leading edge of the folder of FIG. 1 with side flaps partially folded up.
Figure 4:
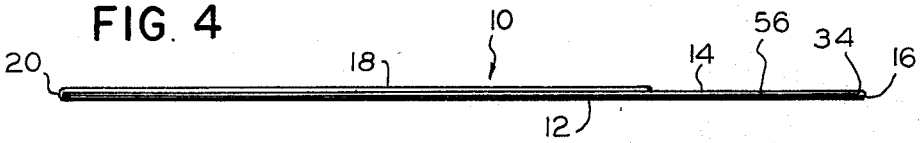
FIG. 4 is an enlarged view of the leading edge of the folder of FIG. 1 taken along line 4—4 of FIG. 3.
Figure 9:
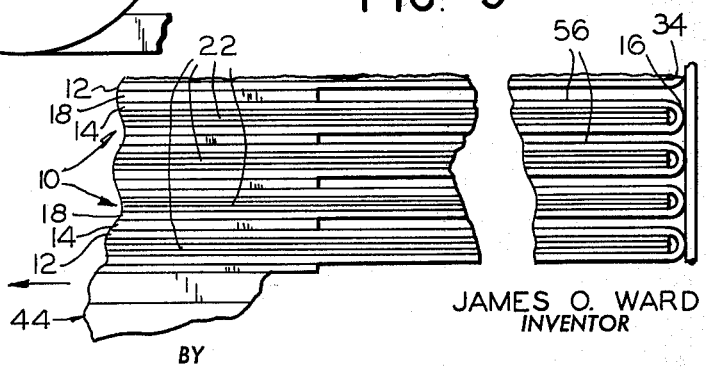
FIG. 9 is an enlarged fragmentary elevational view also at the outfeed station, showing the respective overhang between each folder.

As best seen in FIGS. 3 and 4, the top flap 18, when folded over, leaves a short clearance portion 56 of flap 14 uncovered. This provides clearance for the guide bar 32 (FIG. 6) and also is usable as a hand gripping area for the user. This clearance portion 56 is held to a minimum, a small fraction of the width of the folder, minimizing overhang when stacked, as shown in FIG. 9, thereby maintaining a straight, untilted stack.

Because the dispensing machine feeds from the bottom with a stack of folders pressing down, a low friction type of material is used in making the folders. It has been found that paper stocks having a hard, but not slick, surface are excellent for the folder. The paper preferably should have a basis weight (24 × 36) of from about 54 pounds to 56 pounds, a caliper of from about 0.045 inches to about 0.052 inches, a Mullen of from about 33 to about 36, and a Sheffield smoothness of from about 150 to about 220.

I claim:

1. In a currency holding folder, a generally rectangular bottom panel of paper of slightly greater width and length than a currency bill, a cover flap of paper integral with and joined with a fold to the bottom panel along one edge, and a top flap integral with and joined with a fold to the bottom panel at the opposite edge thereof, the folder being open at both ends and of substantially uniform thickness throughout substantially the entire length thereof across the major portion of the width thereof, the panel and the flaps being completely planar, the panel and the flaps being unsecured together except by the folds, the folder being of such a width that the currency filling it extends fully from one fold to the other fold, the folder being of a length substantially that of the currency, the cover flap extending when the folder is filled with currency fully to the fold of the top flap and the panel so that precise thickness measurement can be made at the last-mentioned edge, the top flap being folded over the cover flap when the folder is filled with currency, the bottom panel having a cutout corner portion adjacent the fold of the cover flap, the flaps also being open at that corner portion to expose corner portions of currency bills in the folder, the cover flap being of a length such that the cover flap extends only from the cutout corner portion to the other end of the bottom panel, the top flap being cutout as said other end of the bottom panel to provide a clearance portion through which the panel and the cover flap can be gripped while permitting the top flap to be opened.

2. The currency holding folder of claim 1 in which the width of the top flap is of substantially less but substantially over half the width of the bottom panel to provide a clearance portion to permit the edge portion of the cover flap to be held closed while permitting the top flap to be opened.

3. In a currency holding folder, a generally rectangular bottom panel of paper of slightly greater width and length than a currency bill, a cover flap of paper integral with and joined with a fold to the bottom panel along one edge, and a top flap integral with and joined with a fold to the bottom panel edge thereof, the folder being open at both ends and of substantially uniform thickness throughout substantially the entire length thereof across the major portion of the width thereof, the panel and the flaps being completely planar, the panel and the flaps being unsecured together except by the folds, the folder being of such a width that the currency filling it extends fully from one fold to the other fold, the cover flap extending, when the folder is filled with currency, fully to the fold of the top flap and the panel so that precise thickness measurement can be made at the last mentioned edge, the bottom panel having a cutout corner portion adjacent the fold of the cover flap and the flaps also being open at that corner portion to expose corner portions of currency bills in the folder.

4. The currency holding folder of claim 3 wherein the cover flap is of a length such that the cover flap extends only from the cutout corner portion to the other end of the bottom panel.

5. A currency holding folder of paper comprising a generally rectangular bottom panel, a cover flap joined by a fold to one edge of the bottom panel, and a top flap joined by a fold to the opposite edge of the bottom panel, the edge of one end of the bottom panel having a jog near the fold joining the cover flap thereto to define a corner cutout portion and the edge of the end of the cover flap adjacent said edge of the bottom panel being straight and forming a continuation of the adjacent portion of said edge of said one end edge of the bottom panel, the cover flap and the bottom panel being otherwise substantially coextensive in length and width, the panel and the flaps being completely planar and completely free of adhesion, the cover flap being positioned between the top flap and the bottom panel when the folder is closed, the edge of the top flap adjacent said one end of the bottom panel forming substantially a continuation of said edge of one end of the bottom panel.

6. In a currency holding folder of paper for use in a currency dispensing machine adapted to measure thickness of the folder and currency held by the folder, a generally rectangular bottom panel of a predetermined width substantially that of currency to be held in the folder, a cover flap joined by a first fold to one edge of the bottom panel, and a top flap joined by a second fold to the opposite edge of the bottom panel, the free edge of the cover flap being slightly bowed or doubly tapered so that the central portion of the cover flap has a width precisely that of the bottom panel and the end portions of the cover flap have a width slightly less than that of the bottom panel, whereby the central portion of the cover flap extends to said opposite edge so that the combined thickness of the bottom panel, the cover flap, the top flap and currency in the folder is present at said opposite edge to enable precise measurement of the combined thickness at said opposite edge.

7. In a currency holding folder, a generally rectangular bottom panel of paper of slightly greater width and length than a currency bill, a cover flap of paper integral with and joined with a fold to the bottom panel along one edge, and a top flap integral with and joined with a fold to the bottom panel at the opposite edge thereof, the folder being open at both ends and of substantially uniform thickness throughout substantially the entire length thereof across the major portion of the width thereof, the panel and the flaps being completely planar, the panel and the flaps being unsecured together except by the folds, the folder being of such a width that the currency filling it extends fully from one fold to the other fold, the cover flap extending, when the folder is filled with currency, fully to the fold of the top flap and the panel so that precise thickness measurement can be made at the last mentioned edge, the cover flap and one corner portion of the bottom panel being cutout to provide a sight opening of the numbered corner portions of bills of currency placed in the folder.

8. In a currency holding folder, a generally rectangular bottom panel of paper of slightly greater width and length than a currency bill, a cover flap of paper integral with and joined with a fold to the bottom panel along one edge, and a top integral with and joined with a fold to the bottom panel at the opposite edge thereof, the folder being open at both ends and of substantially uniform thickness throughout substantially the entire length thereof across the major portion of the width thereof, the panel and the flaps being completely planar, the panel and the flaps being unsecured together except by the folds, the folder being of such a width that the currency filling it extends fully from one fold to the other fold, the cover flap extending, when the folder is filled with currency, fully to the fold of the top flap and the panel so that precise thickness measurement can be made at the last mentioned edge, the top flap being of a width substantially over half the width of the bottom panel and substantially less than the width of the bottom panel to provide an uncovered strip-like edge portion of the cover flap.

9. In a currency holding folder, a generally rectangular bottom panel of paper of slightly greater width and length than a currency bill, a cover flap of paper integral with and joined with a fold to the bottom panel along one edge, and a top flap integral with and joined with a fold to the bottom panel at the opposite edge thereof, the folder being open at both ends and of substantially uniform thickness throughout substantially the entire length thereof across the major portion of the width thereof, the panel and the flaps being completely planar, the panel and the flaps being unsecured together except by the folds, the folder being of such a width that the currency filling it extends fully from one fold to the other fold, the cover flap extending, when the folder is filled with currency, fully to the fold of the top flap and the panel so that precise thickness measurement can be made at the last mentioned edge, only the central portion of the cover flap extending to the fold of the top flap, the edge of the central portion of the cover flap adjacent the fold of the top flap tapering with a large radius curve away from the fold of the top flap proceeding toward each end of the cover flap.

* * * * *

UNITED STATES PATENT OFFICE

CERTIFICATE OF CORRECTION

PATENT NO. : 3,999,701

DATED : December 28, 1976

INVENTOR(S) : JAMES O. WARD

It is certified that error appears in the above-identified patent and that said Letters Patent are hereby corrected as shown below:

Col.2, line 11, after "bills" change "23" to --22--

Col.2, line 26, before "overhang" insert --an--

Col.3, line 47,(claim 1) change "as" to --at--

Col.3, line 64,(claim 3) after "panel" insert --at the opposite--

Col.5, line 25 (claim 8) insert --flap-- after "top"

Signed and Sealed this

Twenty-second Day of March 1977

[SEAL]

*Attest:*

RUTH C. MASON
*Attesting Officer*

C. MARSHALL DANN
*Commissioner of Patents and Trademarks*